United States Patent [19]

McKay

[11] 4,449,709

[45] May 22, 1984

[54] BOARD GAME HAVING MEANS FOR EJECTION OF PLAYING PIECES

[76] Inventor: Robert McKay, 221 N. Hemlock Rd., Wood Dale, Ill. 60191

[21] Appl. No.: 383,522

[22] Filed: Jun. 1, 1982

[51] Int. Cl.[3] ..... A63F 3/00

[52] U.S. Cl. ..... 273/248; 273/290; 273/141 R; 46/145

[58] Field of Search ..... 273/248, 287, 288, 289, 273/290, 243, 281

[56] References Cited

U.S. PATENT DOCUMENTS

| | | | |
|---|---|---|---|
| 3,481,605 | 12/1969 | Giraurd et al. | 273/248 |
| 3,830,501 | 8/1974 | Fabricant | 273/287 |
| 4,128,246 | 12/1978 | Hicks et al. | 273/288 |
| 4,159,117 | 6/1979 | Kuna | 273/243 |

*Primary Examiner*—Richard C. Pinkham
*Assistant Examiner*—Matthew L. Schneider
*Attorney, Agent, or Firm*—Haight, Hofeldt, Davis & Jambor

[57] ABSTRACT

A game board having a plurality of spaces upon which a plurality of primary and secondary playing elements move. The structure of the primary elements is such that the secondary elements can be placed inside of them. In the center of the game board is placed a control device. The control device has a hingedly mounted spinner which controls the amount of movement of the playing elements. The control device further includes a means for ejecting the secondary elements from the primary elements.

6 Claims, 3 Drawing Figures

BOARD GAME HAVING MEANS FOR EJECTION OF PLAYING PIECES

BACKGROUND OF THE INVENTION

This invention is directed to a board game. Such games have long been popular with both children and adults. Usually such games include a board having marked positions for playing elements. The players move these elements from position to position in accord with rules and, often, with reference to a random number generator such as a spinner or dice.

SUMMARY OF THE INVENTION

My invention is a board game which provides factors of skill, chance, and suspense to the players. My preferred commercial embodiment utilizes the theme of clones. The primary playing elements are identified as "masters" while the secondary playing elements are identified as "clones". These playing elements are moved through marked positions by the players in accord with a spinner which generates the number of positions an element can be moved. Initially, the movement is towards a center "clone station" where the masters are cloned. This station includes a device for ejecting clones from the masters. After cloning, the players seek to return their master and clone elements to the starting point while avoiding capture by the elements of the other player.

Accordingly, the objectives of my invention are to provide consumers with a challenging, interesting and exciting board game.

DESCRIPTION OF THE DRAWINGS

The manner in which the above objective is attained is explained in the following specifications and drawings in which.

DETAILED DESCRIPTION

Figure 1:
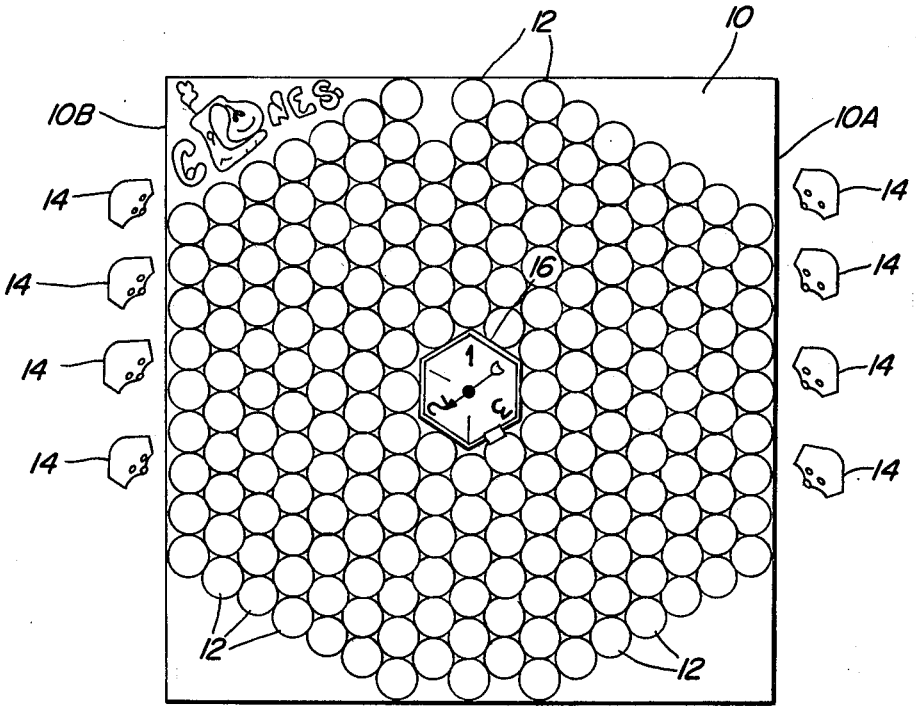
FIG. 1 is a plane view illustrating the preferred embodiment of my invention.

Consideration of FIG. 1 will provide a general understanding of my invention. This figure discloses a regular game board 10 which is foldable along one of its center lines. Printed on the board is the word "CLONES"-the preferred theme of my invention. Also printed on the board are circles 12 which represent marked positions upon which the playing elements move.

As depicted, the board is printed to accommodate two players whose goal is to move their master playing elements from the edge of the board to the clone station 16 and then to return the master elements as well as the secondary elements (clones) back to the edge of the board without being captured.

In the preferred embodiment, each player starts with four master elements 14. These elements are formed of flexible material such as rubber or vinyl. Each is generally semi-spherical in size and has a decorative appearance. In addition, the bottom edge has an inwardly extending lip 18 which receives and retains the secondary playing elements, e.g., the clones 20.

Figure 3:
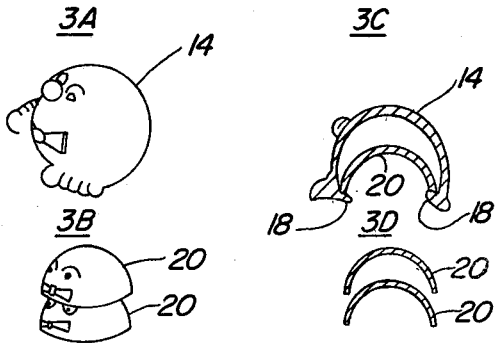
FIG. 3A is a perspective view of the primary or "master" playing elements of my invention.
FIG. 3B is a perspective view of the secondary or "clone" playing elements of my invention.
FIG. 3C is a sectional view of the primary playing element of FIG. 3A, the section being taken along a plane passing through the center.
FIG. 3D is a sectional view of the secondary playing element of FIG. 3B, the section being taken along a plane passing through the center of the element.

The clones are also formed of a flexible material in a semi-spherical shape whose dimensions permit them to be inserted in and retained by the masters 14 as shown in FIG. 3C.

At the start of the game, players on opposite sides of the board 10A and 10B, place the master elements 14 containing the clones 20 on the marked positions adjacent their respective edges. From this position, the master elements 14 are moved toward the clone station 16. Movement is controlled by a spinner 22 which is mounted upon the clone station 16. This spinner 22 is in the shape of an arrow and mounted at 24 for spinning on a surface 26. The players alternately spin the arrow 22 to generate the number of marked positions 12 which they can move one of their master elements 14. If desired, some of the circles or marked positions can be colored to identify positions across which the elements 14 cannot move. Such color coding of certain circles may be used to restrict movement along maze type paths. Thee paths may be skillfully used by the players to permit escape of their elements from their opponent's elements or to capture them.

Figure 2:
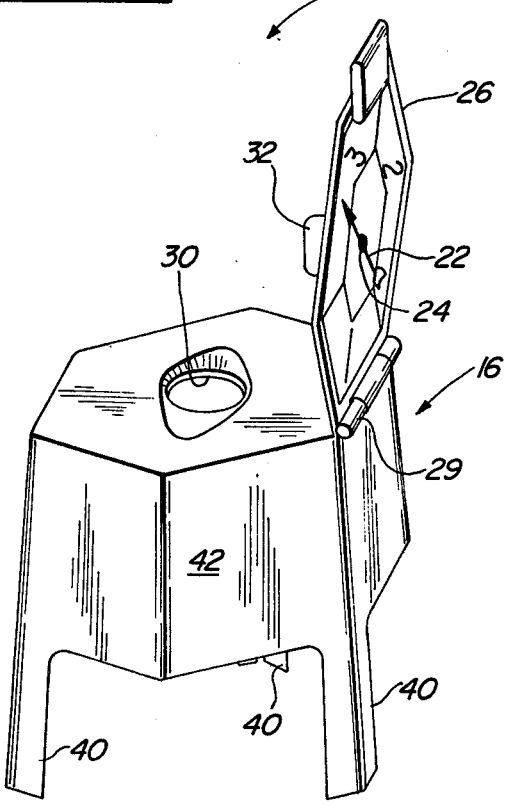
FIG. 2 is a perspective view of the ejection or "clone station" which is positioned in the center of the board of FIG. 1.

When a player manuevers his master elements to one of the circles adjacent the clone station 16, he must generate the number 1 on the spinner 22 to advance the master upon the station for cloning. When the number 1 is generated by a player having a master 14 in an adjacent circle he may pivot the spinner surface 26 upward about hinge 29 to the position shown in FIG. 2, place the master over the aperture 30 on the clone station 16, and clone the master by rotating surface 26 downward. A projection 32 on the lower side of the surface 26 will engage the master 14, and compress it, releasing the secondary elements or clones 20 from the retaining lip 18 of master 14 and ejecting these elements through the aperature 30. After each master has been cloned, the masters 14 and the clones 20 must exit from station 16 on the opponent's side of the station. Each player then tries to return each of his clones to his starting edge without capture. Preferably, the master elements 14 are not returned to the starting edge, but are used capture the other player's secondary elements 20. Capture occurs when a master lands on an opposing player's clone.

The clone station 16 may take many forms. In the preferred embodiment, the station has three support legs 40, a hollow body 42 with the aperture 30 formed in the top. Similarly, the master element 14 and the secondary playing elements may take different shapes, appearances, and themes.

I claim:

1. A board game comprising a. a board having marked positions extending from at least two edges of the board to the center;

b. at least one master playing element which is flexible and hollow, said master element being adapted to receive and retain a secondary playing element;

c. at least one secondary playing element of a size adapted to fit within the master element;

d. a control device adapted to be placed in the center of the board and the marked positions; said control device including selection means for determining the number of marked positions which the elements may be moved and release means for ejecting the secondary playing elements from the master playing elements.

2. A board game as recited in claim 1 in which the control device contains an aperture and said release means includes a pivotal surface for applying force to the master element for ejecting the secondary playing element from the master.

3. A board game as recited in claim 2 in which the selection means is mounted on said pivotal surface.

4. A board game as recited in claim 1 wherein said at least one secondary playing element is configured to simulate the appearance of said at least one first master playing element as a clone thereof.

5. A board game as recited in claim 1 wherein said control device is separate and independent of said at least one first master playing element and said selection means is separate and independent from said at least one secondary playing element, and wherein said release means is separate and independent of said at least one first master playing element.

6. A board game as recited in claim 1 wherein said control device is positionable in a fixed position with respect to said board and said at least one master playing element and said at least one secondary playing element are movable toward and away from said control device upon said board while said control device remains in said fixed position thereon.

* * * * *